US006438328B1

(12) United States Patent
Maltzahn et al.

(10) Patent No.: US 6,438,328 B1
(45) Date of Patent: Aug. 20, 2002

(54) REVERSIBLE SHUTTER LOCKOUT FEATURE

(75) Inventors: Kevin L. Maltzahn, Webster; Christina L. Pierce, Victor; Laurie M. O'Connor, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/708,027

(22) Filed: Nov. 8, 2000

(51) Int. Cl.[7] ..... G03G 15/00
(52) U.S. Cl. ..... 399/12
(58) Field of Search ..... 399/12, 27, 119, 399/120, 224, 258, 262, 263

(56) References Cited

U.S. PATENT DOCUMENTS 4,611,899 A * 9/1986 Kasamura et al. ..... 399/12
4,878,091 A * 10/1989 Morita et al. ..... 399/224
4,924,920 A * 5/1990 Bhagwat ..... 399/258 X
4,937,628 A * 6/1990 Cipolla et al. ..... 399/262 X
5,184,181 A 2/1993 Kurando et al.
5,289,243 A 2/1994 Sakamoto
5,548,384 A * 8/1996 Weed ..... 399/120
5,593,068 A 1/1997 Kitayama et al.
5,610,692 A 3/1997 Trask et al. ..... 399/27
5,737,675 A * 4/1998 Okada et al. ..... 399/258
5,802,435 A 9/1998 Trask et al. ..... 399/224
5,812,914 A 9/1998 Johroku ..... 399/262
5,819,144 A * 10/1998 Okada et al. ..... 399/258
5,970,292 A * 10/1999 Miller ..... 399/262

* cited by examiner

*Primary Examiner*—Sandra Brase
(74) *Attorney, Agent, or Firm*—Oliff & Berridge, PLC

(57) ABSTRACT

A toner container with an orientation dependent shutter mechanism is provided with an orientation independent shutter lockout feature to ensure that a toner container's shutter will not open unless the toner container is inserted properly into a corresponding toner compartment, thereby ensuring that the proper color toner will be inserted into the toner compartment.

24 Claims, 7 Drawing Sheets

REVERSIBLE SHUTTER LOCKOUT FEATURE

BACKGROUND OF THE INVENTION

1. Field of the Invention

This invention relates to containers usable to hold xerographic development toner.

2. Description of Related Art

Photocopier development devices employ toner containers to supply development toner to a substrate on which a latent image has been formed. Toner containers take a number of forms, including cartridges and bottles. Both toner cartridges and toner bottles have dispensing openings through which the toner is dispensed into one or more toner development stations. In some instances, the toner bottles and cartridges are provided with shutters usable to open and close the dispensing openings. The shutters, which are located in shutter assemblies attached to the toner containers, are designed to be opened after the toner containers are properly inserted into a toner development receptacle or station. Some shutter assemblies are provided with a lockout mechanism portion located on one side of the assembly to prevent the shutters from being opened unless and until the toner cartridge is properly placed in the appropriate toner development compartment, receptacle or station, which will be referred to collectively as a toner compartment.

Color photocopying machines have provision for a number of toner bottles of different color toners, such as, for example, the three subtractive chromatic primary colors of cyan, yellow and magenta, and the achromatic color black. A color photocopier typically has four toner container compartments, each with a toner development station and provision for accepting a corresponding color toner container.

Toner containers which have a shutter lockout mechanism may be designed so that the lockout mechanism mates with a corresponding shutter lockout mechanism element associated with the toner compartment, so that only a toner bottle storing a particularly colored toner will properly fit into that corresponding color toner compartment. For example, the toner container shutter lockout mechanism of a cyan toner compartment is designed to permit only a cyan toner container with a cyan shutter lockout mechanism to properly fit into the cyan toner compartment. A cyan shutter lockout mechanism is designed and configured to prevent non-cyan toner containers from properly fitting into the cyan color compartment.

SUMMARY OF THE INVENTION

One known toner container which has a shutter lockout mechanism has a shutter assembly with a single-sided shutter lockout mechanism portion located adjacent one end of the container. When a shutter assembly with a single-sided shutter lockout mechanism portion is assembled to this type of toner container, the shutter assembly sometimes is inadvertently assembled in a reverse orientation, i.e., rotated 180 degrees from its proper orientation. Accordingly, a toner container with a single-sided shutter assembly lockout mechanism portion can be designated as orientation-dependent. The lockout mechanism portion of shutter-orientation-dependent toner containers, in which the shutter assembly has been mis-oriented when assembled will not work properly, because such a toner container will still fit into any of the provided toner compartments and the shutter can be opened despite the presence of the mis-oriented shutter lockout mechanism. In other words, unless an orientation-dependent toner container with a mis-oriented shutter lockout mechanism, for example a cyan color toner container, is matched with the corresponding color, e.g., cyan toner compartment, the wrong color toner may be supplied to the cyan color compartment.

This invention provides an orientation-independent shutter lockout mechanism usable with toner containers.

This invention separately provides a dual-sided shutter lockout mechanism usable with toner containers.

In various exemplary embodiments of the orientation-independent shutter lockout mechanism according to this invention, the orientation-independent shutter lockout mechanism includes a shutter assembly having a plurality of shutter lockout mechanisms. In various exemplary embodiments, the shutter assembly according to this invention is formed adding a second shutter lockout mechanism portion to the opposite side of the shutter assembly from the side of the shutter assembly which has a first shutter lockout mechanism portion, so that both sides of the toner container shutter assembly have a shutter lockout mechanism. This double lock-out shutter mechanism portion assembly feature results in a shutter assembly that is orientation-independent, and thus reduces the chance of the shutter assembly being inserted into a toner container incorrectly, and reduces the chance that the wrong color toner will be added to a toner development compartment.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
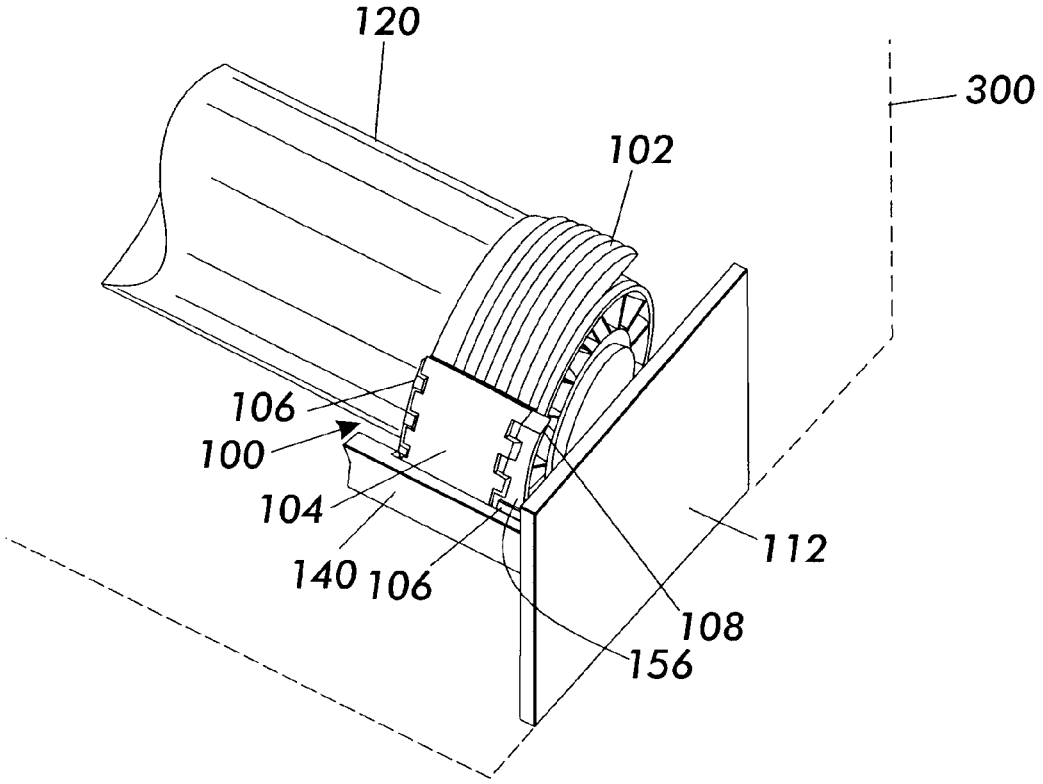
FIG. 1 is a perspective view of a toner container with an orientation-dependent shutter lockout mechanism assembly.

FIG. 1 shows a conventional orientation-dependent toner container 120 having a number of fixed rails 102 on which a properly oriented orientation-dependent shutter assembly 100 is movably mounted. The orientation-dependent shutter assembly 100 has a first side portion 106 and a second side portion 156 with a lockout mechanism portion 108 which extends outwardly from the second side portion 156. The orientation-dependent toner container 120 is shown positioned with respect to a toner compartment interface 112 which has a toner compartment shutter interlock mating post 110.

The toner compartment shutter interlock mating post 110 is to be inserted into a corresponding mating post slot 128 of the lockout mechanism portion 108 to prevent a machine operator from placing an orientation-dependent toner container 120 in the wrong toner color compartment 300. Each toner compartment 300 has a toner compartment interface 112 with a toner compartment shutter interlock mating post 110 positioned in such a way that only the correct color toner container 120 with a corresponding-shaped and/or positioned mating shutter interlock mechanism portion slot 128 can be properly inserted into that toner compartment 300. If a toner container 120 is placed into the wrong toner compartment 300, the post 110 on the toner compartment interface 112 will not line up with the mating post slot 128. Thus, the toner container 120 is prevented from fitting into the toner compartment 300.

If the toner container 120 is placed in the proper toner compartment 300 and the shutter lockout mechanism slot 128 is properly engaged with the toner compartment interface post 110, the shutter blade 104 can be opened. In particular, the shutter blade 104 is opened by turning the toner container 120. Specifically, the bar 140 located beneath the orientation-dependent shutter assembly 100 and the post 110 on the toner compartment interface 112 holds the orientation-dependent movably mounted shutter assembly 100 stationary. At the same time, the toner container 120 and the fixedly mounted rails 102, on which the shutter assembly 100 is movably mounted, turn to expose the toner supply opening (not shown) and permit the toner to be supplied from the toner container 120 to the toner compartment 300. The bar 116 forms part of the assembly which prevents a toner cartridge 120 from opening and supplying toner into the wrong toner compartment 300.

Figure 2:
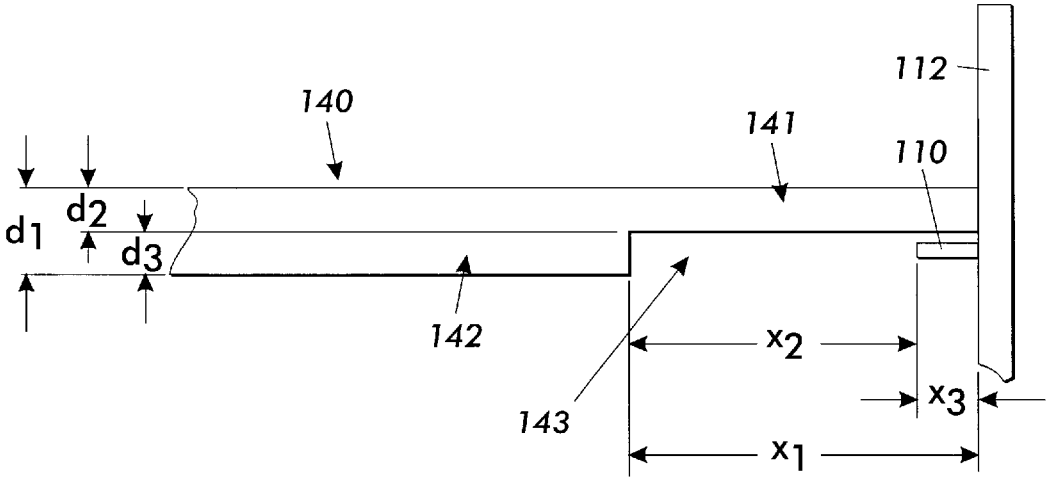
FIG. 2 is a schematic top view of details of toner compartment elements of FIG. 1.
Figure 3:
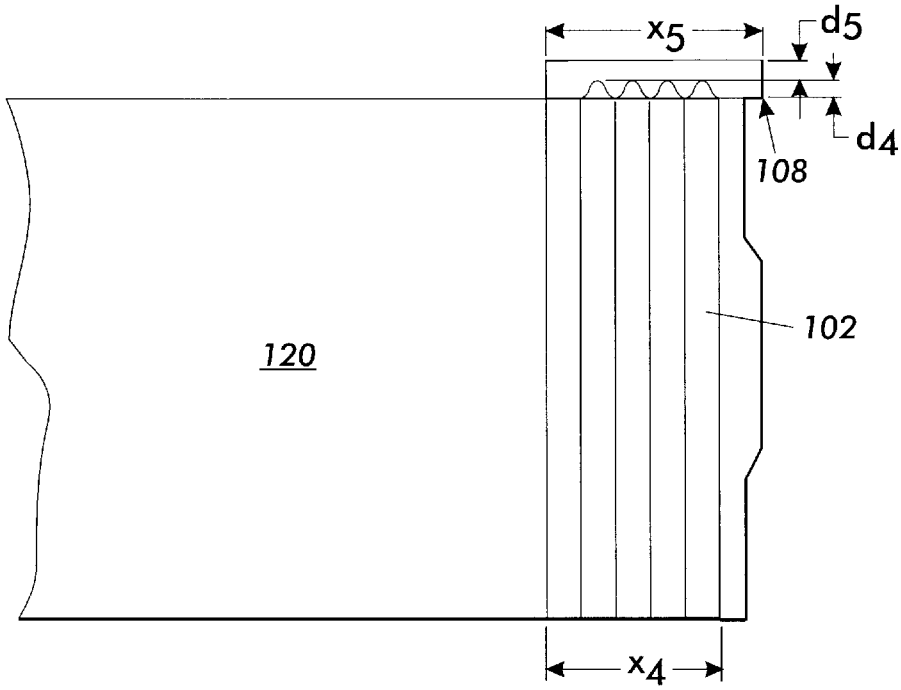
FIG. 3 is a schematic top view of a toner cartridge having an orientation-dependent shutter assembly.

FIG. 2 shows details of the bar 140. The bar 140 has a relatively narrow portion 141 close to the machine toner compartment interface 112, a wider portion 142 spaced a distance $x_1$ from the interface 112, and a notched portion 143. The width of the wider portion 142 of the bar 140 is $d_1$. The width of the relatively narrow portion 141 of the bar 140 is $d_2$. The toner compartment insertion post 110 has a length $x_3$, which is less than length $x_1$ of the relatively narrow portion 141. As shown in FIG. 2, $x_1=x_2+x_3$. FIG. 3 shows the width $x_4$ of the rail portion 102 of the cartridge 120. The width Wt is less than $x_1$, but is greater than $x_2$, so that if the toner container 120 is properly inserted in the toner compartment 300, i.e., when the insertion post 110 is fully inserted into the corresponding lockout mechanism slot 128 in the shutter lockout mechanism portion 108, the rail portion 102 fits in the notched portion 143 of the bar 140.

FIG. 3 shows the toner container 120 with the rail portion 102. The width of the rail portion 102 is $x_4$. However, the width of the shutter assembly 100 with the lockout mechanism portion 108 is $x_5$, which is greater that $x_4$. When the toner container 120 is properly inserted into a toner compartment 300, the toner container 120, including the rail portion 102, which is fixedly, i.e., substantially non-movably connected to the toner container 120, can be rotated about the longitudinal axis of the container while the movably mounted shutter assembly 100 is prevented from moving, i.e., is held relatively stationary by the bar 140 in general, and by the relatively narrow portion 141 in particular.

However, if the toner container 120 with a properly oriented shutter assembly portion 100 is inserted into the wrong color toner compartment 300, the toner compartment insertion post 110 will not mate with the shutter lockout mechanism insertion slot 128. As a result, the toner container 120 cannot be fully inserted into that wrong color toner compartment 300 and the rail portion 102 of the toner container will not fit into the notched portion 143 of the bar 140. Instead, a portion of the rail 102 of the toner container 120 will abut on the wide portion 142 of the bar 140, and will be prevented by the bar 140 from being able to rotate about the longitudinal axis of the toner container 120.

Also, the rail portion 102 of the toner container 120 is non-movably fixed to the toner container 120. Thus, the toner container 120 will be prevented from being able to be rotated about its longitudinal axis. As a result, if the toner container 120 is inserted into the wrong toner compartment 300, the toner container 120 cannot be rotated to open the toner container's toner supply opening. However, if a toner container 120 is inserted into the correct toner compartment 300, the insertion post 110 will be inserted into the corresponding slot 128 in the lockout mechanism portion 108 and the toner container will be inserted as far as possible into the toner compartment 300. Under these circumstances, the toner container rails 102 on which the shutter assembly 100 is mounted will fit into the notched portion 143 of the bar 140. Accordingly, the toner container 120 can be rotated while the shutter assembly 100 is prevented from moving by the relatively narrow portion 141 of the bar 140.

FIG. 3 shows that the rail portion 102 does not extend beyond the edge of the toner container 120 on which the rail portion 102 is mounted. In contrast, the shutter lockout mechanism portion 108 extends beyond the edge of the toner container 120. The rail portion 102 of the toner container 120 sticks out a distance $d_4$ from the outer circumference of the toner container 120. The distance $d_4$ is less than the depth $d_3$ of the notched portion 143. The shutter assembly 100, which is slidably mounted on the rail portion 102, sticks out an additional distance $d_5$ from the outer circumference of the toner container 120, so that the shutter assembly 100 will always be prevented from being rotated along with the toner container 120 by the bar 140.

As a result, the toner container 120 which has a misoriented shutter assembly 100 can be inserted far enough into the toner compartment 300 to permit the toner container supply opening to be opened upon rotation of the toner container.

Figure 4:
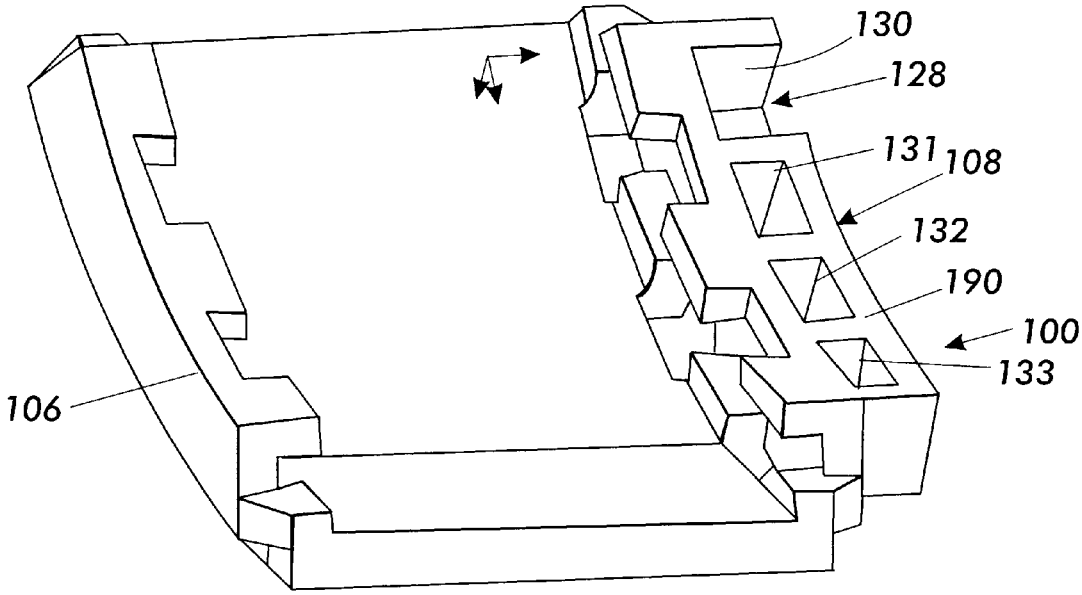
FIG. 4 is a perspective view of the underside of an orientation-dependent shutter mechanism of FIG. 1.

FIG. 4 shows construction details of the orientation-dependent shutter assembly 100. The orientation dependent shutter assembly 100 has shutter assembly side portions 106, a shutter lockout mechanism portion 108 mounted on one shutter assembly side portion 106, and a shutter blade portion 104. The shutter lockout mechanism portion 108 has one slot 128 which is configured and located to mate with a corresponding toner compartment lockout post 110. The shutter lockout mechanism portion 108 has four lockout post template holes 130–133 which define locations where one or more of the slots 128 can be provided. Each slot 128 is located in one of the four lockout post template hole locations 130–133, and is formed by removing a wall portion 190 adjacent to one of the four the lockout post template holes 130–133.

Figure 5:
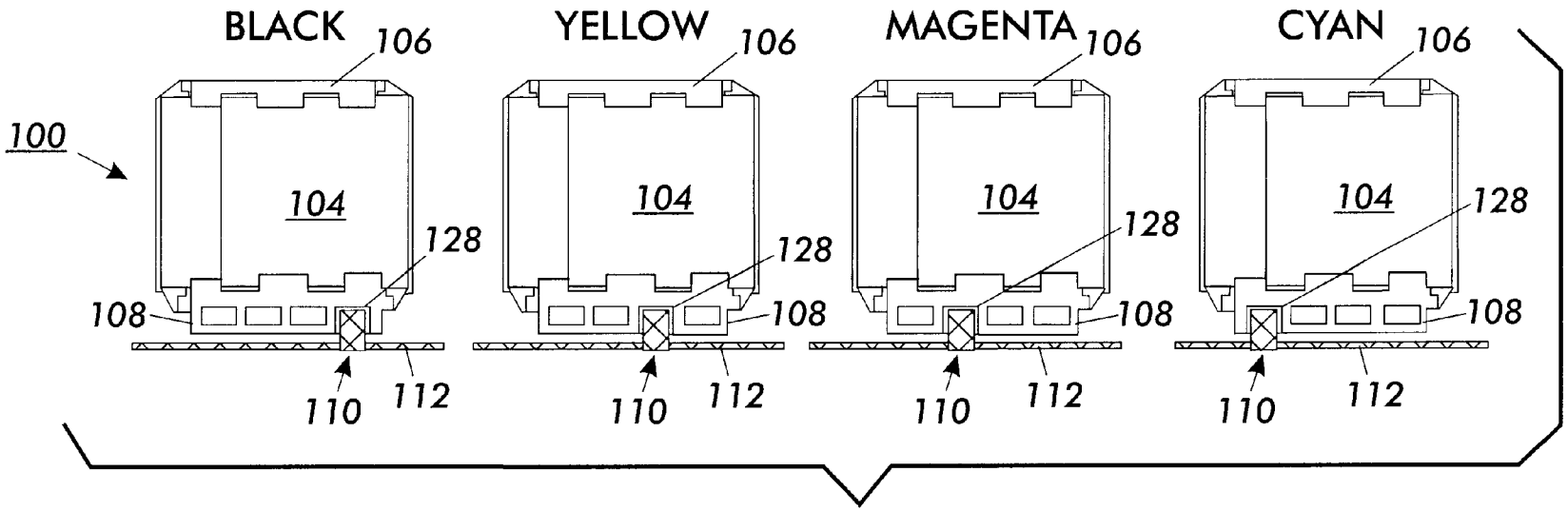
FIG. 5 is a side view of four orientation-dependent shutter assemblies mated with four toner compartment components.

FIG. 5 shows one exemplary embodiment of the location of shutter lockout mechanism lockout post template holes 130–133 and an actual lockout mechanism slot for four different color toner shutter lockout mechanisms. In this illustrative embodiment, the black toner container lockout mechanism slot 128 is located in the farther right-of-center lockout port template hole 130 location. The yellow toner container lockout mechanism slot 128 is located in the nearer right-of-center lockout port template hole 131 location. The magenta toner container lockout mechanism slot 128 is in the nearer left-of-center lockout port template hole 132 location. The cyan toner lockout mechanism slot 128 is located in the farther left of center lockout port template hole 133 location. As shown, a shutter lockout post 110 is positioned to be inserted into a corresponding shutter lockout mechanism slot 128. These orientations are illustrative only, and any particular slot location may be selected for any particular toner color. Moreover, more or fewer posts 110 and slots 128 may be provided, depending on the number of toner colors used.

Figure 6:
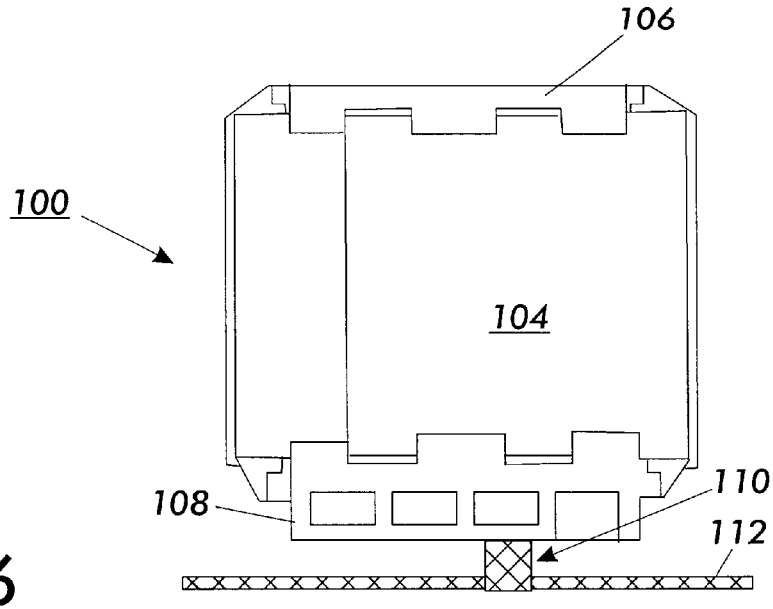
FIG. 6 is a side view of a toner container having an orientation-dependent shutter assembly which is properly assembled to a toner container but installed in the wrong toner compartment.

FIG. 6 shows a black toner container with a properly oriented shutter lockout mechanism which someone has attempted to place into a yellow toner compartment 300. The shutter lockout post 110 mounted on the yellow toner compartment interface 112 does not fit into the black toner shutter lockout mechanism slot 128 because the post 110 does not line up with the slot 128. As a result, the shutter assembly 100 does not properly interface with the toner compartment, precluding the opening of the shutter blade 104, preventing the toner container from being inserted into the toner compartment 300.

Figure 7:
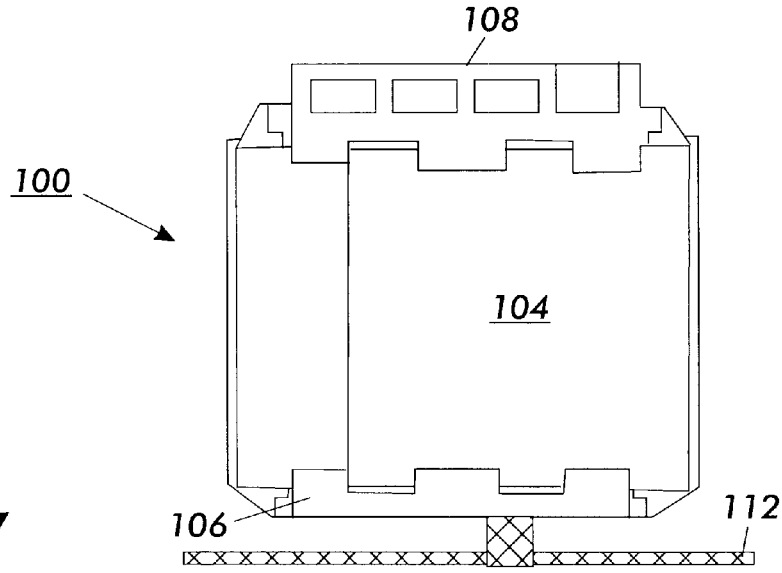
FIG. 7 is a side view of a toner container having an orientation-dependent shutter assembly which is improperly assembled to a toner container and installed in any toner compartment.

FIG. 7 shows the situation in which the orientation-dependent shutter assembly 100 has been improperly installed onto the toner container 120, so that the side 106 of the shutter assembly 100 which does not have the shutter lockout mechanism portion 108 faces the post 110 when the toner container 120 is inserted into the toner compartment 300. Although the toner compartment post 110 cannot fit into the slot 128 because that slot is not adjacent the post 110, the toner container 120 can be inserted into the toner compartment 300 as far as is needed to fit in the notched portion 143 of the bar 140, so that the shutter assembly 100 is held in a stationary position by the bar 140 beneath the shutter assembly 100, while the toner container 120 is rotated about its longitudinal axis, resulting in exposing the supply opening (not shown) of the toner container 120 to supply toner into the toner compartment 300. As a result, the wrong toner may be supplied to any of the four toner compartments.

Figure 8:
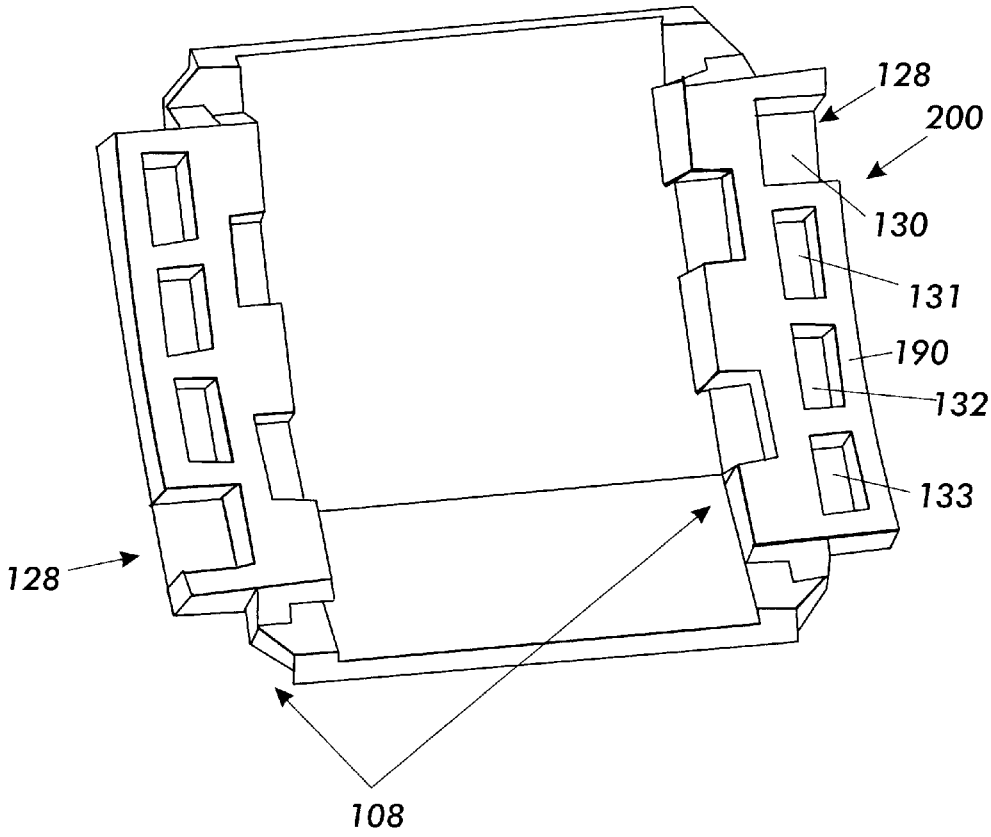
FIG. 8 is a side view of an orientation-independent toner shutter assembly having two shutter lockout mechanisms according to the invention.

FIG. 8 shows an exemplary embodiment of an orientation-independent shutter assembly 200 according to the invention. As shown in FIG. 8, the orientation-independent shutter assembly 200 has shutter lockout mechanism portions 108 on both sides 106 of the orientation-independent shutter assembly 200. The shutter assembly 200 differs from the orientation dependent shutter assembly 100 in that the orientation-independent shutter assembly 200 has lockout mechanism portions 108 provided on both sides 106 of the orientation-independent shutter assembly 200. The lockout slot 128 in the shutter lockout mechanism portion 108 located on a first side 106 of the orientation-independent shutter assembly 200 is in the same relative position as the shutter lockout mechanism portion 108 provided on the second, opposite side 106. Thus, when the orientation-independent shutter assembly 200 is assembled onto a toner container 120, a shutter lockout mechanism slot 128 which mates with a corresponding toner compartment interface post 110 will always be provided on the side of the toner container nearest to the toner compartment interface post 110. This significantly reduces the possibility of installing a wrong toner container 120 in a toner compartment 300.

Figure 9:
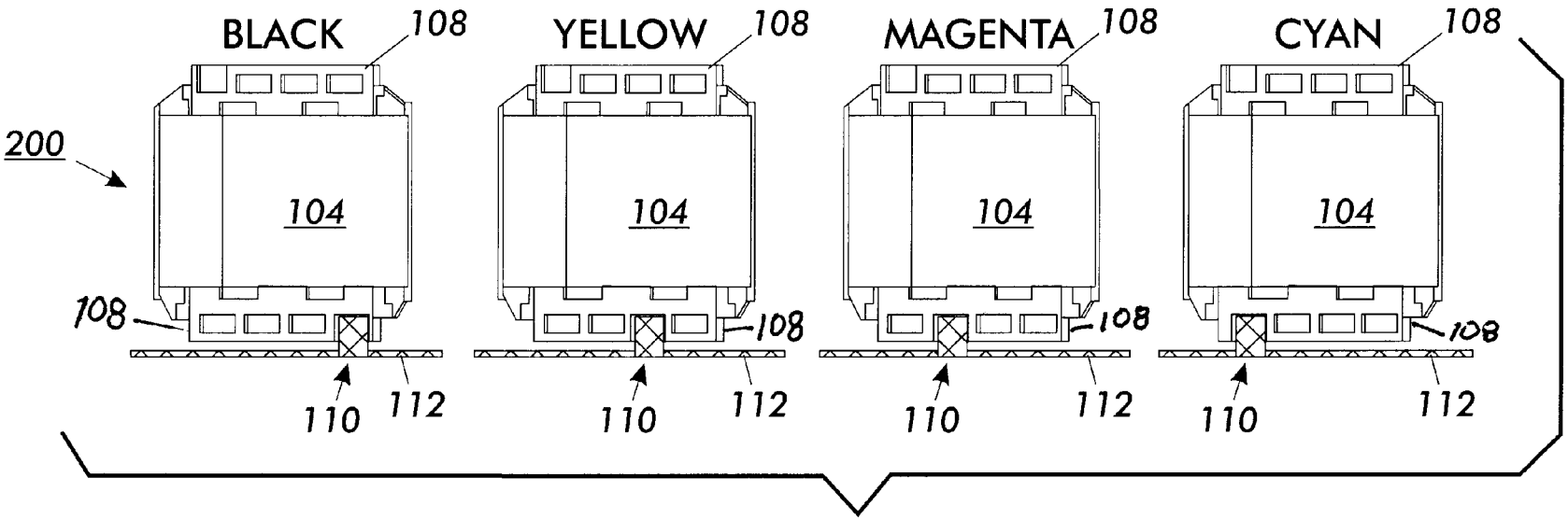
FIG. 9 is a side view of four different orientation-independent toner shutter assemblies, each having two shutter lockout mechanisms according to the invention, properly interfaced with four corresponding toner compartments.

FIG. 9 shows a number of orientation-independent shutter assemblies 200 with dual shutter lockout mechanisms 108 properly inserted against toner compartment interfaces 112 and shutter lockout mechanism posts 110 for four differently colored toners. It should also be noted, for example, that a photocopier need not have four different color toners, but may have more than one toner compartment 300 configured to use the same color toner. In that situation, each toner container having the same color will have shutter lockout mechanism portions 108 which have the same configuration.

One advantage of the dual shutter lockout mechanism, orientation-independent shutter assemblies 200 is that their proper assembly onto a toner cartridge is simplified. In particular, the orientation-independent shutter assemblies 200 may be oriented either in a first orientation or in a second orientation which is rotated 180 degrees away from the first orientation, and the assembled orientation-independent shutter assembly 200 will remain properly oriented. Another advantage is that regardless of which of the two orientations is used to assemble the dual shutter lockout mechanism orientation-independent shutter assembly 200 onto a toner container, there will be a significantly reduced chance of a toner container 120 opening in the wrong color toner compartment 300.

It should be emphasized that the arrangement, size, shape and number of the slots 128 and mating posts 110 may vary from what is shown, as well as the size and shape of the toner container 120, the shutter assemblies 100 or 200, and components of the toner compartment 300.

While this invention has been described in conjunction with the exemplary embodiment outlined above, it is evident that many alternatives, modifications and variations will be apparent to one of ordinary skill in the art. Accordingly, the exemplary embodiment of the invention, as set forth above, is intended to be illustrative, and not limiting. Various changes may be made without departing from the spirit and scope of the invention.

What is claimed is:

1. A method of making orientation-independent an orientation-dependent shutter assembly for a toner cartridge insertable in a toner compartment having a single shutter lockout mechanism for assembly in one of two different orientations on the shutter assembly each orientation of which can prevent an orientation-dependent toner container from fitting properly for operation in the wrong toner compartment, comprising:

providing the shutter mechanism with a second shutter lockout mechanism to prevent an orientation-dependent toner container from fitting properly for operation in the wrong toner compartment regardless of in which one of the two different orientations the shutter assembly is assembled on the toner cartridge.

2. A method according to claim 1, wherein the first shutter lockout mechanism is located on a first side of the shutter assembly, further comprising locating the second shutter lockout mechanism on a second side of the shutter assembly.

3. A method according to claim 2, wherein the second side of the shutter assembly is opposite the first side of the shutter assembly.

4. A method according to claim 1, wherein the second shutter lockout mechanism has the same configuration as the first shutter lockout mechanism.

5. A method according to claim 1, wherein the different orientations are reverse orientations.

6. An orientation-independent shutter lockout mechanism for a toner cartridge insertable in a toner compartment having plural lockout mechanisms for assembly in one of two different orientations on the shutter assembly each orientation of which can prevent an orientation-dependent toner container from fitting properly for operation in the wrong toner compartment, comprising:

a shutter assembly mountable in one of two possible orientations on the toner container;

a first shutter lockout mechanism provided on a first side of the shutter assembly; and a substantially identical second shutter lockout mechanism provided on the opposite side of the shutter assembly to provide one shutter lockout in each of the two different orientations to prevent an orientation-dependent toner container from fitting properly for operation in the wrong toner compartment regardless of in which one of the two different orientations the shutter assembly is assembled on the toner cartridge.

7. The orientation independent shutter lockout mechanism of claim 6, wherein the shutter assembly lockout mechanism contains an opening to receive a lockout element provided on a corresponding proper toner compartment.

8. The orientation independent shutter lockout mechanism of claim 7 wherein the lockout-element is a post.

9. The orientation independent shutter lockout mechanism of claim of claim 6, wherein the shutter assembly is movably mounted on a toner container.

10. The orientation independent shutter lockout mechanism of claim 9 further comprising a rail assembly interposed between the toner container and the movably mounted shutter assembly.

11. The orientation-independent shutter lockout mechanism of claim 10, wherein the rail assembly is non-movably mounted on the toner container and the shutter assembly is movably mounted on the rail assembly.

12. The orientation-independent shutter lockout mechanism of claim 11, wherein the bar prevents the shutter from rotating when the toner container is rotated.

13. The orientation-independent shutter lockout mechanism of claim 9 further comprising a bar against which the shutter assembly is placed when the toner container is rotated.

14. The orientation-independent shutter lockout mechanism of claim 6, further including a rail assembly on which the shutter assembly is mounted.

15. The orientation-independent shutter lockout mechanism of claim 6 wherein the different orientations are reverse orientations.

16. A toner container, having an orientation-independent shutter lockout mechanism that prevents the toner cartridge from opening and supplying toner into the wrong toner compartment by engaging a toner compartment engagement element, the toner cartridge being insertable into a toner compartment, comprising:

a toner housing;

a shutter assembly mounted on the toner housing;

first and second shutter substantially identical lockout mechanisms provided on opposite sides of the shutter assembly, only one of which engages with the toner compartment engagement element to prevent an orientation-dependent toner container from fitting properly for operation in the wrong toner compartment.

17. In an orientation dependent toner container or cartridge having a shutter assembly and a single shutter lockout mechanism to prevent an orientation-dependent toner container from fitting properly for operation in the wrong toner compartment, the improvement comprising:

a second shutter lockout mechanism provided on the shutter mechanism, wherein only one shutter assembly shutter lockout mechanism interconnects with the toner compartment to further prevent the toner cartridge from properly fit and operation unless the toner cartridge is properly oriented in a corresponding toner compartment.

18. An orientation independent shutter assembly, including a shutter, for a toner cartridge for attachment to the toner cartridge, comprising:

a first elongated shutter lockout mechanism located on one side of the shutter assembly and a second, substantially identical elongated shutter lockout mechanism located on the opposite side of the shutter assembly in reverse orientation from the first elongated shutter lockout mechanism.

19. A method of making orientation-independent, an orientation-dependent toner cartridge having a single shutter assembly having a single shutter lockout mechanism, to prevent the toner cartridge from opening and supplying toner into the wrong toner compartment, comprising:

providing a substantially identical second shutter lockout mechanism on the shutter assembly reverse oriented with respect to the single shutter lockout mechanism.

20. An orientation-independent shutter lockout mechanism that prevents the toner cartridge from opening and supplying toner into the wrong toner compartment, comprising:

a shutter assembly;

a first elongated shutter lockout mechanism located on a first side of the shutter assembly; and a second elongated shutter lockout mechanism located on a second side of the shutter assembly in reverse orientation with respect to the first shutter lockout assembly.

21. The device of claim 20, wherein the first and second elongated shutter lockout mechanisms are located at approximately the same position, approximately parallel to each other along the axis along which the shutter moves.

22. A method of making orientation-independent, an orientation-dependent toner cartridge having a shutter assembly having a single elongated lockout mechanism, for use in device having at least one matching and at least one non-matching toner compartments, comprising:

providing a second elongated shutter lockout mechanism on the shutter assembly in reverse orientation with respect to the first elongated shutter lockout mechanism to prevent the toner cartridge from opening and supplying toner into a non-matching toner compartment regardless of the orientation of the toner cartridge.

23. A method of making orientation-independent an orientation-dependent shutter assembly for a toner cartridge insertable in a toner compartment which has an engagement element and having a single shutter lockout mechanism for engagement with the toner compartment engagement element and for assembly in one of two possible complementary orientations on the shutter assembly each orientation of which can prevent an orientation-dependent toner container from fitting properly for operation in the wrong toner compartment depending on the orientation of the shutter assembly on the toner cartridge, comprising:

providing the shutter mechanism with a second shutter lockout mechanism so that the toner compartment engagement element engages with only one of the two shutter lockout mechanisms to prevent an orientation-dependent toner container from fitting properly for operation in the wrong toner compartment regardless of in which one of the two possible orientations the shutter assembly is assembled on the toner cartridge.

24. A toner container with a shutter assembly assemblable in two different orientations on the toner container, for use in a toner compartment with an engagement element, the improvement comprising:

the shutter assembly having two shutter lockout mechanisms, one on each of two opposing sides of the shutter assembly, each shutter mechanism constructed to engage with an engaging element located on a toner compartment;

wherein only one of the shutter lockout mechanisms engages with the toner compartment engagement mechanism when the toner container is properly inserted in the toner compartment.

* * * * *